US009204222B2

(12) United States Patent
Suvanto

(10) Patent No.: US 9,204,222 B2
(45) Date of Patent: Dec. 1, 2015

(54) TRANSDUCER APPARATUS WITH A TENSION ACTUATOR

(75) Inventor: Mikko Veli Aimo Suvanto, Wilkinsburg, PA (US)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 13/984,395

(22) PCT Filed: Feb. 25, 2011

(86) PCT No.: PCT/IB2011/050813

§ 371 (c)(1),
(2), (4) Date: Sep. 5, 2013

(87) PCT Pub. No.: WO2012/114156

PCT Pub. Date: Aug. 30, 2012

(65) Prior Publication Data

US 2014/0294226 A1 Oct. 2, 2014

(51) Int. Cl.

| | |
|---|---|
| ***H04R 3/00*** | (2006.01) |
| ***H04R 7/24*** | (2006.01) |
| ***H04R 1/04*** | (2006.01) |
| ***H04R 1/22*** | (2006.01) |

(52) U.S. Cl.

CPC .. *H04R 7/24* (2013.01); *H04R 1/04* (2013.01); *H04R 1/22* (2013.01); *H04R 3/00* (2013.01); *H04R 2201/003* (2013.01)

(58) Field of Classification Search

CPC ..... H04R 7/16; H04R 7/18; H04R 7/20; H04R 7/22; H04R 7/24; H04R 7/26

USPC ..... 381/111–117, 174–176; 257/416; 361/283.4; 438/53

See application file for complete search history.

(56) References Cited

U.S. PATENT DOCUMENTS

| | | | | |
|---|---|---|---|---|
| 4,151,378 | A | 4/1979 | Watson | |
| 6,563,934 | B1 * | 5/2003 | Swope et al. | 381/427 |
| 2005/0190944 | A1 | 9/2005 | Akino et al. | |
| 2008/0075306 | A1 * | 3/2008 | Poulsen et al. | 381/111 |
| 2009/0016550 | A1 * | 1/2009 | Qiao | 381/175 |

FOREIGN PATENT DOCUMENTS

| | | |
|---|---|---|
| EP | 0561566 | 9/1993 |
| EP | 1771036 | 4/2007 |
| GB | 361988 | 12/1931 |
| JP | 2007274096 | 10/2007 |
| WO | 9965277 | 12/1999 |
| WO | 2007054589 | 5/2007 |
| WO | 2010150660 | 12/2010 |

OTHER PUBLICATIONS

Extended European Search Report received for corresponding European Application No. 011859545.3-1910, dated Jun. 11, 2014, 7 pages.

International Search Report received for corresponding Patent Cooperation Treaty Application No. PCT/IB2011/050813, dated May 8, 2012, 5 pages.

* cited by examiner

*Primary Examiner* — Matthew Eason

(74) *Attorney, Agent, or Firm* — Harrington & Smith

(57) ABSTRACT

An acoustic transducer comprising: a flexible membrane; and a tension actuator, wherein the tension actuator is configured to be electrically controllable and define to the acoustic properties of the transducer dependent on the tension of the membrane.

18 Claims, 5 Drawing Sheets

TRANSDUCER APPARATUS WITH A TENSION ACTUATOR

RELATED APPLICATION

This application was originally filed as PCT Application No. PCT/IB2011/050813 filed Feb. 25, 2011.

FIELD OF THE APPLICATION

The present invention relates to a transducer apparatus. The invention further relates to, but is not limited to, a transducer apparatus for use in mobile devices.

BACKGROUND OF THE APPLICATION

Many portable devices, for example mobile telephones, contain a number of acoustic transducers, such as microphones, earpieces and speakers. Such transducers are key components in mobile phone audio/acoustic design. Generally, there will be one or more sound channels or back cavities associated with each acoustic transducer. Such sound channels can ensure a certain frequency response is obtained for the transducer, and must be carefully designed as part of the mechanical configuration of the device hardware. Small changes in the size and configuration of the sound channels or cavities can have a large effect on the acoustic properties of the combined transducer/sound channel.

In known acoustic transducer configurations, the mechanical design of the sound channels is fixed at the point of hardware design and manufacture of the device is completed, and cannot be later adapted during use for a specific purpose or desired configuration. Instead, the desired acoustic properties are produced by filtering the electrical signal representing the sound output before the signal is applied to the transducer. Typically, this requires the use of significant processing power, commonly provided by dedicated digital signal processors (DSPs).

Furthermore there is a limit to the modification of the acoustic response of the transducer which can be carried out in the DSP.

Microphones are typically designed to be as sensitive as possible so that the signal to noise ratio is as high as possible. The consequences of the design to be as sensitive as possible are that the gap between the membrane and the back plate typically must be as small as possible in order to maximise the capacitance between the two plates (the membrane being the first plate, and the back plate being the second plate). Furthermore to design the microphone to be as sensitive as possible, the compliancy of the membrane should be as high as possible so that the membrane vibrates as sensitively as possible along with any sound pressure level change.

The problem associated with such a design is that the membrane of the microphone can touch the back plate easily, for example when a large sound pressure level is experienced. This touching or contact could cause the membrane to stick to the back plate permanently, in other words producing a permanent malfunction of the microphone. When the membrane sticks or touches to the back plate temporarily, this produces a temporary malfunction whereby the microphone is non-functional until it can be reset. Furthermore if the membrane only touches the back plate temporarily and does not stick to the back plate, the resultant signal output by the microphone produces a bad audible distortion. This audible distortion is often called microphone saturation and cannot easily be remedied or compensated for using digital signal processing.

An example of the limitations of the mechanical design of typical microphone transducers is that of wind noise. Wind noise is a problem particularly for miniaturised designs such as found in mobile phone where there is no room for mechanical protection of the microphone from wind such as used in broadcast microphones like wind screens or foam protectors. Furthermore filtering out the wind noise from the signal in the electrical domain, not only requires significant processing power in a digital signal processor, but typically produces poor results as the sound pressure levels generated by the wind cause the microphone acoustic element to saturate.

Thus when the microphone is exposed to significant wind the microphone plates are forced together and produces a saturated signal outputting "wind noise" which cannot be removed from the signal.

A further example of the limitations of the mechanical design of a typical microphone would be at a loud event, such as a rock concert. In such events, the optimal sensitivity of the microphone is significantly less than the optimal sensitivity in quiet surroundings. Too high a sensitivity of the microphone during such events will cause the microphone to saturate at the high sound pressure levels and the resulting audio signal is heavily distorted and compressed. The results of which is a big drop in quality and a barely listenable recording of the event.

Although the sensitivity and mechanical saturation suppression can be affected by choosing the design of the microphone to have the desired mechanical or acoustical properties, these are typically fixed in manufacturing which requires compromises to be made in the design and during the use of the component. Furthermore as discussed, although there are ways to adjust the sensitivity of microphones such as adjusting the gain in the microphone preamplifier, or by changing the bias voltage of the microphone element, these techniques cannot overcome the problem of mechanical saturation of the microphone in loud or windy conditions.

STATEMENT OF THE APPLICATION

This application proceeds from the consideration that the provision of an adjustable tensioning of the transducer membrane may provide suitable sensitivity adjustment and as such provide wind noise reduction in audio capture environments.

It is an aim of at least some embodiments of the invention to address one or more of these problems.

According to a first aspect of the application there is provided an acoustic transducer comprising: a flexible membrane; and a tension actuator, wherein the tension actuator is configured to be electrically controllable and define to the acoustic properties of the transducer dependent on the tension of the membrane.

The membrane tensioner may comprise: at least one charged member configured to be electrically controllable, wherein each charged member is configured to controllably apply a force to the membrane to define a tension in the membrane.

The acoustic transducer may further comprise a back plate, wherein the at least charged member is coupled to the back plate.

The flexible membrane may be charged and wherein the force is substantially defined by the relative charges of the at least one charged member and the flexible membrane.

The acoustic transducer may further comprise a membrane charged member coupled to the membrane and wherein the force is substantially defined by the relative charges of the at least one charged member and the membrane charged member and substantially independent from the relative charges of the at least one charged member and the flexible membrane.

The force may comprise at least one of: an attractive force; a repulsive force; a first force associated with a first direction; and a further force associated with a further direction.

The charged member may comprise at least one of: an electrostatically charged member; and an electrically charged member.

The at least one charged member may comprise a profiled charged member, wherein the profile of the charged member is configured to define a direction component of the force.

The acoustic transducer may comprise at least one of: a microphone; and a speaker.

An apparatus may comprise: the acoustic transducer as described herein; and a controller configured to control the tension actuator.

The apparatus may further comprise a sensor configured to determine the activity of the acoustic transducer, wherein the controller is further configured to control the tension actuator dependent on the sensor activity value.

The apparatus may further comprise a filter configured to receive the output of the acoustic transducer, wherein the controller is configured to control the filter dependent on the sensor activity value.

The apparatus may further comprise a sensor configured to determine the acceleration of the acoustic transducer, wherein the controller is further configured to control the tension actuator dependent on the acceleration of the acoustic transducer.

The controller may be configured to control the tension actuator in at least one of: a binary mode of control; a discrete stepwise control; and a continuous mode of control.

According to a second aspect there is provided a method comprising: providing a flexible membrane; and electrically controlling a tension actuator to define to the acoustic properties of the transducer dependent on the tension of the membrane.

Electrically controlling a tension actuator may comprise: electrically controlling at least one charged member, wherein each charged member is configured to controllably apply a force to the membrane to define a tension in the membrane.

The method may further comprise coupling the at least one charged member to a back plate of the actuator.

The method may further comprise charging the flexible membrane, wherein the force is substantially defined by the relative charges of the at least one charged member and the flexible membrane.

The method may further comprise physically coupling a membrane charged member to the membrane, wherein the force is substantially defined by the relative charges of the at least one charged member and the membrane charged member and substantially independent from the relative charges of the at least one charged member and the flexible membrane.

The force may comprise at least one of: an attractive force; a repulsive force; a first force associated with a first direction; and a further force associated with a further direction.

Electrically controlling the charged member may comprise at least one of: electrically controlling an electrostatically charged member; and electrically controlling an electrically charged member.

The at least one charged member may comprise a profiled charged member, wherein the profile of the charged member is configured to define a direction component of the force.

The acoustic transducer may comprise at least one of: a microphone; and a speaker.

The method may further comprise: determining the activity of the acoustic transducer, wherein electrically controlling a tension actuator further comprises controlling the tension actuator dependent on the activity of the acoustic transducer value.

The method may further comprise filtering an output of the acoustic transducer dependent on the activity of the acoustic transducer value.

The method may further comprise determining the acceleration of the acoustic transducer, wherein electrically controlling a tension actuator further comprises controlling the tension actuator dependent on the acceleration of the acoustic transducer.

Electrically controlling a tension actuator may comprise controlling the tension actuator in at least one of: a binary mode of control; a discrete stepwise control; and a continuous mode of control.

According to a third aspect there is provided an apparatus comprising electrically controllable means for mechanically altering the tension of the microphone membrane.

According to fourth aspect there is provided an apparatus comprising at least one processor and at least one memory including computer code, the at least one memory and the computer code configured to with the at least one processor cause the apparatus to at least perform: determining the activity of an acoustic transducer; and electrically controlling the tension actuator dependent on the activity of the acoustic transducer value.

According to a fifth aspect there is provided an apparatus comprising at least one processor and at least one memory including computer code, the at least one memory and the computer code configured to with the at least one processor cause the apparatus to at least perform: determining the acceleration of the acoustic transducer; and electrically controlling the tension actuator dependent on the acceleration of the acoustic transducer value.

SUMMARY OF FIGURES

For better understanding of the present invention, reference will now be made by way of example to the accompanying drawings in which.

DESCRIPTION OF EXAMPLE EMBODIMENTS

Figure 1:
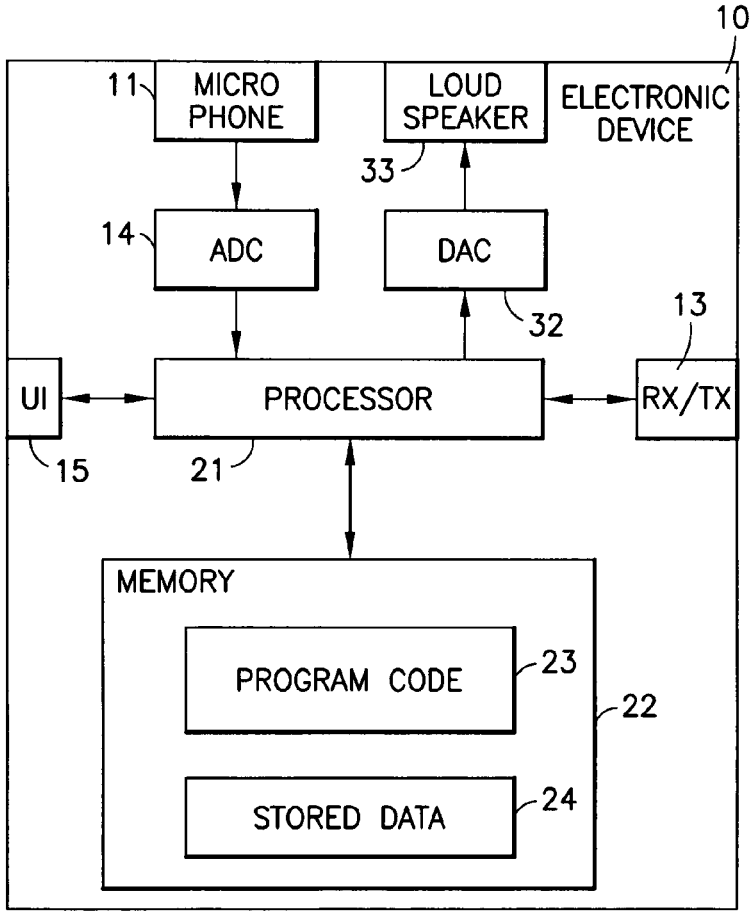
FIG. 1 shows schematically an electronic device employing embodiments of the invention.

The following describes in further detail suitable apparatus and possible mechanisms for the provision of transducers having changeable acoustic properties. In this regard reference is first made to FIG. 1 which shows a schematic block diagram of an exemplary apparatus or electronic device 10, which may incorporate transducers having changeable acoustic properties according to some embodiments. In the following examples and embodiments the transducer receives or generates analogue signal which is processed by an associated analogue to digital converter, however it would be understood that in some embodiments the microphone/speaker is an integrated transducer generating digital or receiving digital signals directly. The electronic device 10 may for example be a mobile terminal or user equipment of a wireless communication system.

The electronic device 10 comprises a microphone 11, which is linked via an analogue-to-digital converter (ADC) 14 to a processor 21. The processor 21 is further linked via a digital-to-analogue (DAC) converter 32 to loudspeakers 33. The processor 21 is further linked to a transceiver (TX/RX) 13, to a user interface (UI) 15 and to a memory 22.

The processor 21 may be configured to execute various program codes. The implemented program codes may comprise transducer control code routines. The implemented program codes 23 may further comprise tension actuator control code. The implemented program codes 23 may be stored for example in the memory 22 for retrieval by the processor 21 whenever needed. The memory 22 may further provide a section 24 for storing data.

The user interface 15 may enable a user to input commands to the electronic device 10, for example via a keypad, and/or to obtain information from the electronic device 10, for example via a display. The transceiver 13 enables a communication with other electronic devices, for example via a wireless communication network. The transceiver 13 may in some embodiments of the invention be configured to communicate to other electronic devices by a wired connection.

It is to be understood again that the structure of the electronic device 10 could be supplemented and varied in many ways.

A user of the electronic device 10 may use the microphone 11 for inputting speech, or other sound signal, that is to be transmitted to some other electronic device or that is to be stored in the data section 24 of the memory 22. A corresponding application has been activated to this end by the user via the user interface 15. This application, which may be run by the processor 21, causes the processor 21 to execute the encoding code stored in the memory 22.

The analogue-to-digital converter 14 may convert the input analogue audio signal into a digital audio signal and provides the digital audio signal to the processor 21.

The processor 21 may then process the digital audio signal in the same way as described with reference to the description hereafter.

The resulting bit stream is provided to the transceiver 13 for transmission to another electronic device. Alternatively, the coded data could be stored in the data section 24 of the memory 22, for instance for a later transmission or for a later presentation by the same electronic device 10.

The electronic device 10 may also receive a bit stream with correspondingly encoded data from another electronic device via the transceiver 13. In this case, the processor 21 may execute the decoding program code stored in the memory 22. The processor 21 may therefore decode the received data, and provide the decoded data to the digital-to-analogue converter 32. The digital-to-analogue converter 32 may convert the digital decoded data into analogue audio data and outputs the analogue signal to the loudspeakers 33. Execution of the decoding program code could be triggered as well by an application that has been called by the user via the user interface 15.

In some embodiments the loudspeakers 33 may be supplemented with or replaced by a headphone set which may communicate to the electronic device 10 or apparatus wirelessly, for example by a Bluetooth profile to communicate via the transceiver 13, or using a conventional wired connection.

In some embodiments the hardware integration of the transducers, such as the microphone 11 or the speaker 33, is in the form of a micro electromechanical system (MEMS) integrated circuit implementation. Although the description herein further details the operation of embodiments of the application with respect to microphone transducers it would be appreciated that the similar apparatus and methods can be employed to speaker operations and/or combined microphone speakers.

Figure 2A:
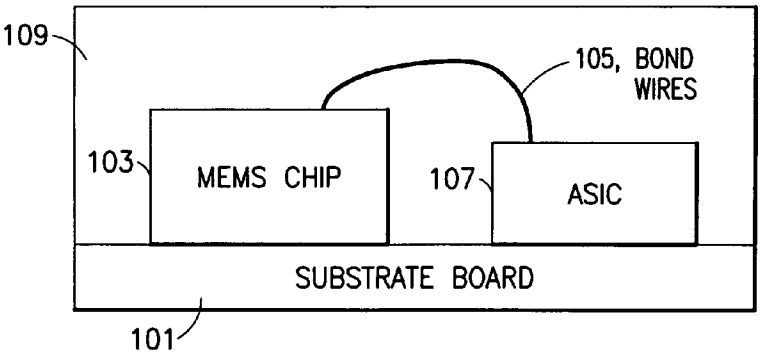
FIG. 2*a* shows schematically the electronic device in further detail.

With respect to FIG. 2*a* an example of the hardware integration of the transducer is shown within the electronic device or apparatus 10 according to some embodiments. In some embodiments the transducer and in particular the microphone 11 can be implemented as a micro-electromechanical system (MEMS) implemented on an integrated circuit or chip. Although the apparatus and methods described herein relate to a MEMS microphone transducer, any transducer employing a membrane (or surface, or diaphragm) for generating or detecting acoustic waves can implement similar embodiments. For example any suitable condenser microphone can employ a tension actuator as described herein.

The MEMS chip 103 can in some embodiments be mounted physically on the substrate board 101 within the casing 109 of the electronic device or apparatus 10. The MEMS chip 103 furthermore in some embodiments can be located neighbouring an acoustic portal provided within the casing of the electronic device or apparatus. The acoustic portal is configured to allow acoustic signals to pass 'through' the casing of the apparatus between the transducer and the environment the apparatus is operating in. In some embodiments the acoustic portal can be at least one hole in the casing. The hole can furthermore be covered in some embodiments by a dust or water resistant or proof screen to prevent foreign bodies from entering the device and damaging any components within the apparatus. The MEMS chip 103 can in some embodiments be mechanically and/or electrically fixed on the substrate 101 to prevent movement of the MEMS chip 103 and/or locate the MEMS chip 103 relative to the acoustic portal in the apparatus. In some embodiments the MEMS chip 103 can be mechanically located (mounted) on the substrate board 101 in such a manner that audio waves can pass through the acoustic portal (and in some embodiments sound channels between the casing and the MEMS chip 103) in the casing 109 to the MEMS chip 103. In some embodiments the substrate board 101 can itself comprise a sound channel through which the acoustic waves pass through.

Figure 2B:
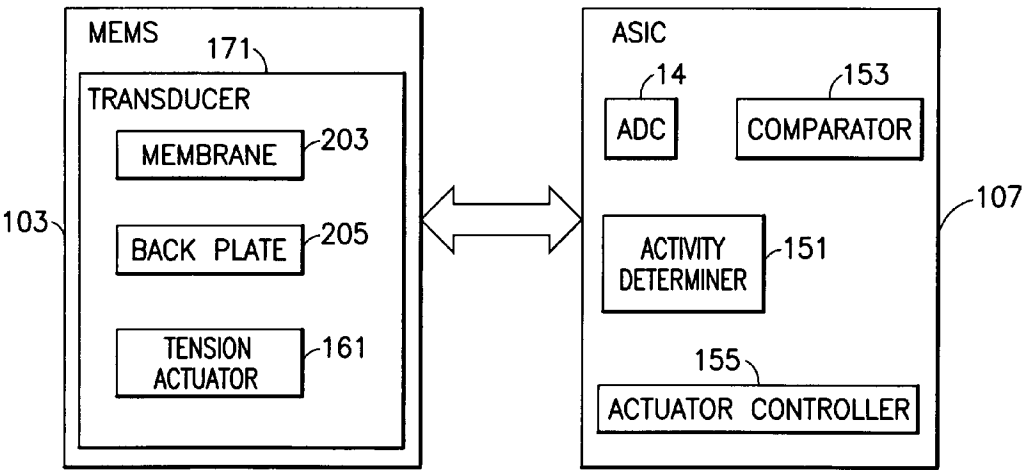
FIG. 2*b* shows schematically some functional components of the electronic device according to some embodiments.

With respect to FIG. 2*b*, a schematic view of the MEMS chip 103 is shown.

In some embodiments the MEMS chip comprises a transducer 171, which is configured in the description herein to be operated as the microphone 11. In some embodiments the MEMS chip 103 can comprise further transducers configured to operate as further microphones and/or configured to operate as a loudspeaker 33. However for clarity the following describes embodiments of the application having a single transducer/single microphone implementation.

In some embodiments the transducer 171 comprises a membrane 203, a back plate 205, and a tension actuator 161 or means for tensioning the membrane.

The membrane 203 can be formed from any suitable material and is configured to move in response to acoustic signals (sound pressure level changes) applying a force against the membrane. In some embodiments the membrane 203 can be configured to be mechanically coupled to an actuator such as a moving magnet or moving coil to generate an electrical signal in response to the movement of the membrane. In some other embodiments, the membrane is electrostatically or electrically charged and causes a change in potential as the membrane moves. For example in some embodiments the membrane 203 is configured to be a mobile capacitor plate relative to a fixed capacitor plate provided by the back plate 205. In such embodiments electrical couplings to each of the membrane 203 and back plate 205 when charged can produce a varying potential as the membrane 203 moves relative to the back plate 205.

The tension actuator 161 comprises an electrically controllable means for mechanically altering the tension of the microphone membrane 203.

The back plate 205 is a material layer which can in some embodiments underlie the microphone membrane 203 and defines a "back volume" or acoustic chamber behind the back plate 205. The relative position and form of the back plate 205 can in some embodiments be designed as a compromise between producing a good noise performance and overall size of the transducer as it would be understood that a smaller back volume is preferable to produce a smaller MEMS chip or transducer but producing a less acceptable noise spectrum of the noise floor output by the transducer.

In some embodiments the back plate 205 comprises at least one back plate hole. The back plate hole is representative of at least one back plate hole attempting to minimise the noise contribution caused by acoustic resistance that affects the air moving between the back plate 205 and the membrane 203. In other words the air "pumped" by the membrane has an open path to the back volume because of the back plate holes. Thus the holes are configured such that any over or under pressure within the back volume between the membrane 203 and back plate 205 can be equalised via the hole with the volume behind the back plate 205. In some embodiments the back plate hole can be more than a single hole and be any suitable shape. In some other embodiments the back plate hole can be located or formed in any support structure which also forms or defines the acoustic chamber. In some embodiments the back plate hole can be covered or at least partially covered to prevent or reduce foreign bodies entering the acoustic chamber, for example metallic or electrostatically charged particles within the apparatus migrating to the transducer and damaging the membrane.

A first example of the structure of the tension actuator 161 within an MEMS microphone 103 is shown with respect to FIGS. 3, 4 and 5*a*, 5*b* and 5*c*.

Figure 3:
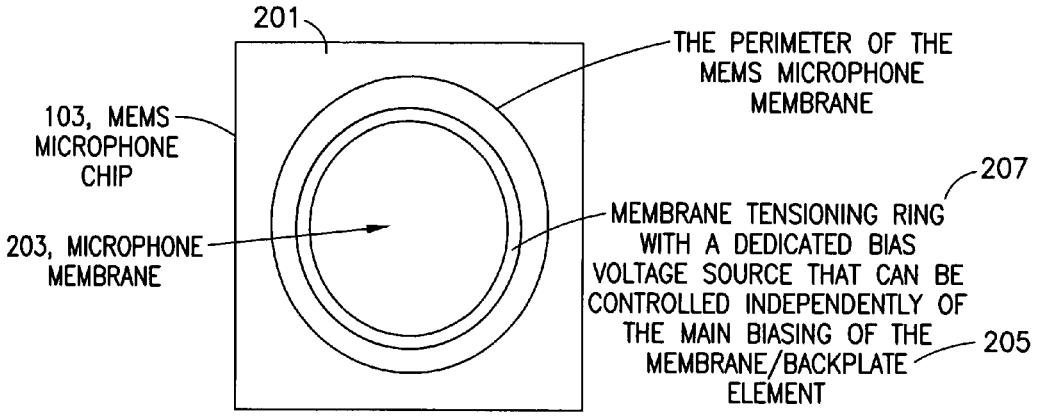
FIG. 3 shows schematically an example topology for the transducer according to some embodiments.

With respect to FIG. 3 a plan view of a MEMS microphone is shown. The MEMS microphone chip 10 is shown comprising a support structure 201 or support frame configured to support elements of the microphone such as the membrane 203 and the back plate 205. The support frame 201 can in some embodiments, for example, be part of the external structure of the MEMS chip 103 into or through which a cavity can be machined for locating the membrane and/or back plate. The support frame 201 in some embodiments can be circular, as shown in FIG. 3, however in other embodiments the support structure cavity can be any suitable shape such as octagonal, regular or irregular in nature. In some embodiments the membrane 203 is supported or located not by a physical support but is 'free floating' and attached to the body of the MEMS chip by electrostatic forces.

Within the support frame 201 of the MEMS chip 103 the microphone membrane 203 can be fixed at its edge and located such that at least a portion of the membrane can move in response to acoustic wave pressure (also known as sound pressure level changes). Also, within the support frame 201 of the MEMS chip 103 can be fixed the back plate at the back plate periphery or edge and located "underneath" the membrane where underneath specifies the direction opposite to the impact of the acoustic waves on the membrane 203. Furthermore the relative location of the microphone membrane 203 and the back plate 205 defines a "back volume" or acoustic chamber. The back volume/acoustic chamber can, as described herein, be designed such that the microphone is configured to produce a suitable frequency response or sensitivity.

Although the back plate and back volume as shown in FIGS. 4 and 5*a*, 5*b* and 5*c* are orientated below the membrane as the acoustic waves are, in this example, acting on the membrane from the upper surface, it would be understood that the orientation of the membrane and relative positions of the back plate and therefore the back volume can be in any suitable direction. Furthermore although a single back plate is shown, it would be understood that in some embodiments a second "back plate" could be located "above" the membrane suitable for detecting acoustic waves operating on the membrane from below.

Figure 4:
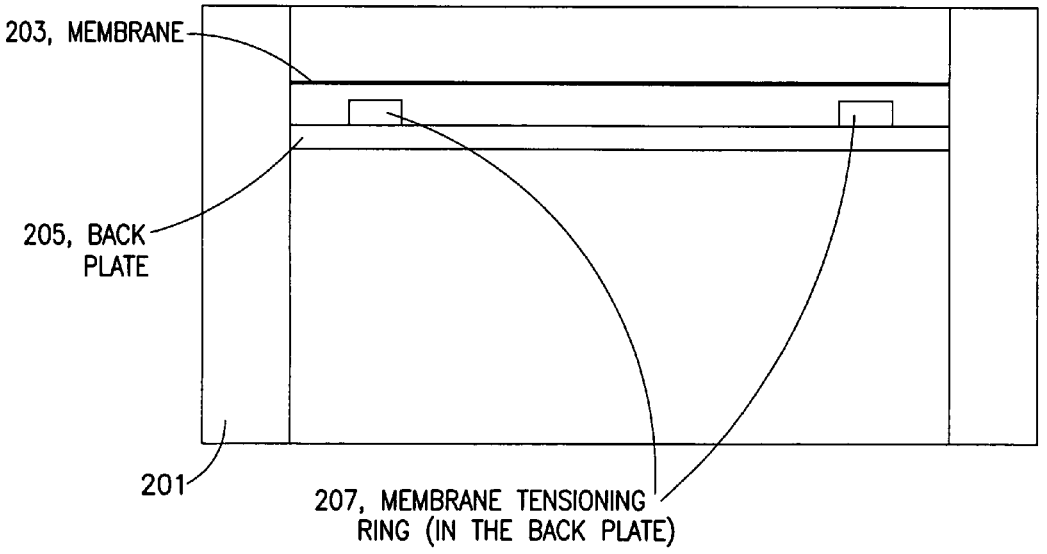
FIG. 4 shows schematically a further view of the example topology of the transducer according to some embodiments.

The MEMS microphone 103 can in some embodiments further comprise the tension actuator 161 in the form of a membrane tensioning ring 207. The membrane tensioning ring 207 as shown in FIG. 3 is a ring of material located close to the periphery of the MEMS microphone membrane or the perimeter of the MEMS microphone membrane and located below the membrane 203. In the example shown in FIG. 4, the membrane tensioning ring 207 is located on the upper surface of the back plate 207. However in some embodiments the membrane tensioning ring 207 can be implemented on a separate support structure. Furthermore in some embodiments the membrane tensioning ring is positioned "above" the membrane and thus as shown herein not only increases the tension and therefore reduces the pliancy of the membrane 203 but moves the membrane away from the back plate 205 thus further reducing the possibility of membrane back plate collisions or touching. The membrane tensioning ring 207 as shown in FIG. 4 can in some embodiments be shaped with a substantially flat upper surface which is wider than it is high. In other words the membrane tensioning ring is considered to be relatively "flat" and exerts a force substantially downwards on the membrane.

The membrane tensioning ring 207 can in some embodiments be electrically isolated from the back plate and be configured to receive an electrical or electrostatic charge. The membrane tensioning ring 207 can thus be provided with a dedicated and independent bias voltage source which can be controlled independently of the biasing of the membrane and back plate element. In some embodiments the membrane 203 can have located on its "underneath" (or in some embodiments "over") surface a further conductive surface which is isolated from the membrane 203. This further surface or layer can furthermore be biased with respect to the tensioning ring or feature. This in some embodiments permits the tensioning of the membrane to be made completely independently of the bias voltage on the membrane 203 and the back plate 205.

Figure 5A:
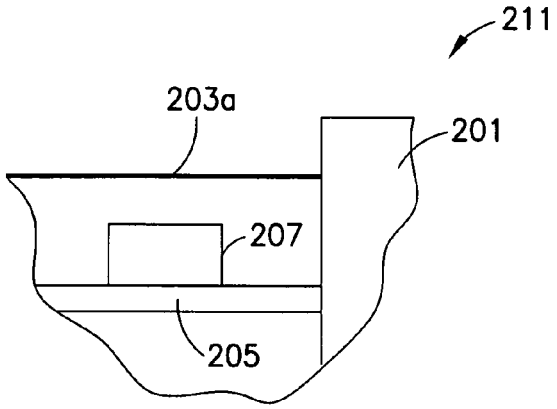
FIGS. 5*a*, 5*b*, and 5*c* show schematically the tensioning of the membrane according to some embodiments.
Figure 5B:
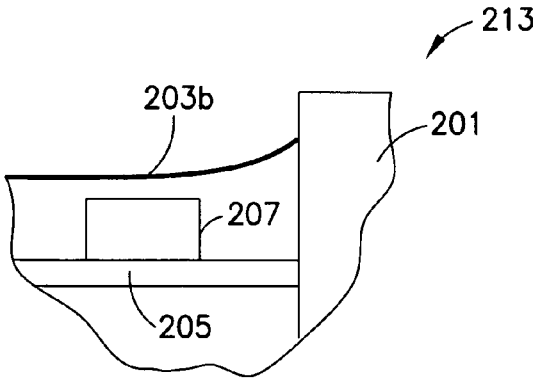
Figure 5C:
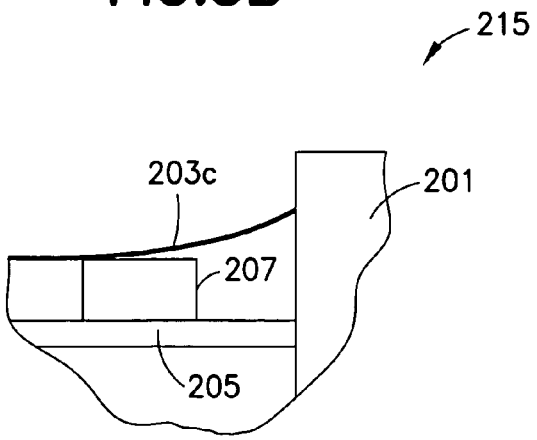

With respect to FIGS. 5*a*, 5*b* and 5*c* the operation of the membrane tensioning ring 207 is shown in further detail. With respect to FIG. 5*a*, the operation of the membrane tensioning ring when deactivated is shown. The deactivated membrane tensioning ring 207 is shown in insert 211. In such a mode of operation there is no charge (electrical or electrostatic) within the tensioning ring and thus no force exerted by the tensioning ring onto the membrane 203. In this example the membrane 203*a* is able to rest in its natural position at a distance from the membrane tensioning ring 207 and back plate 205. Although the natural membrane resting position is shown as a relatively horizontal position, it would be understood that the weight of the membrane and the electrical pull force between the membrane and the back plate could itself cause a slight bending, thus producing a catenary shape of the microphone membrane.

With respect to FIG. 5*b* the operation of the membrane tensioning ring when operating in a partially tensioned mode of operation is shown. In such an example the membrane tensioning ring 207 is provided with an electrostatic or electrical potential opposite to the membrane bias which causes the membrane to be attracted to the membrane tensioning ring 207. The natural resistance or resilience of the membrane 203*b* is shown in FIG. 5*b* insert 213 where a partially tensioned or curved portion of the membrane is shown but where the membrane is closer to the back plate 205 for the central portion of the membrane as force exerted on the membrane moves the membrane towards the tensioning ring and the membrane is put under greater tension due to the additional curvature of the membrane surface.

Furthermore with respect to FIG. 5*c* a completely or fully tensioned membrane 203*c* is shown. In this example the membrane tensioning ring 207 is provided with a stronger opposite electrostatic or electrical potential than the partially tensioned example which further attracts the membrane such that the membrane is electrostatically or electrically attached temporarily to the membrane tensioning ring 207, thus forming a fully tensioned portion between the inside edges of the membrane tensioning ring 207 as the path of the curved portion is even greater and being located closer to the back plate 205.

It would be understood that in some embodiments the control of the tensioning ring 207 can be either binary, in other words fully (or completely) tensioned and not tensioned, or gradual so that the tensioning the voltage can either be discretely or continuously adjusted to tension the membrane to the desired amount as is discussed herein.

Figure 6:
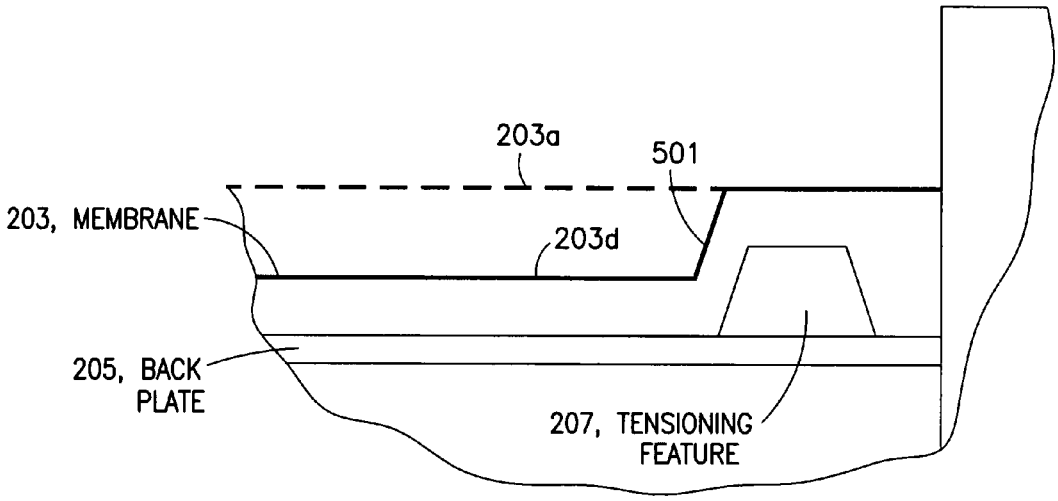
FIG. 6 shows schematically a further tensioning actuator configuration according to some embodiments.

With respect to FIG. 6 a further example topology of the membrane tensioning ring 207 is shown. In the example shown in FIG. 6, the membrane tensioning ring 207 is not "flat" but has a shape or profile which directs the membrane under tension towards the perimeter of the membrane. For example in some embodiments the tensioning ring can have a trapezoidal cross-section or profile where the base is wider than the top surface of the cross-section. Thus the membrane 203 when attracted by the tensioning ring experiences not only a downwards directional force to the back plate but also an outwards force generated by the sloped side of the tensioning ring. This force effectively creates further tensioning as the membrane lengthens as it wraps over the tensioning feature surface. This effect can be seen by the extension of the membrane and therefore tensioning of the membrane between the untensioned membrane 203*a* and the wrapped membrane 203*d* which effectively tensions the membrane 203 as shown by the force arrow 501.

It would be understood in some embodiments that the tensioning of the microphone membrane effectively tunes the response of the MEMS microphone, in other words provides a means for providing or producing a suitable frequency response of the microphone. The tensioning of the membrane can therefore affect the sensitivity of the membrane. Furthermore the tensioning of the microphone membrane permits the membrane to be protected from permanently or temporarily contacting, sticking or touching the back plate as by tensioning the membrane, it is less pliable and therefore less likely to be forced into impacting onto the back plate.

With respect to FIGS. 2*a* and 2*b* are shown apparatus for controlling the operation of the membrane tensioning ring or tension actuator 161. For example the apparatus as shown in FIG. 2*a* comprises an application specific integrated circuit (ASIC) 107 located on the substrate board 101 with the MEMS chip 103 and coupled to the MEMS chip 103 via a bond wire 105. The ASIC 107 can in some embodiments be optional with the functionality of the ASIC 107 implemented by other elements such as for example a processor running programs to perform the same functionality, the programs being stored on a memory which can also be used to store data to be processed or having been processed. In some embodiments the ASIC 107 or at least some elements of the ASIC 107 as described herein can be implemented within the MEMS chip 103. For example in some embodiments the analogue-to-digital converter 14 can be implemented within the MEMS chip 103.

With respect to FIG. 2*b*, the application specific integrated circuit (ASIC) 107 according to some embodiments of the application is shown in further detail. In such embodiments the ASIC 107 can comprise an analogue-to-digital converter (ADC) 14 which is configured to receive from the microphone (or transducer 171 operating as the microphone) and convert analogue electrical signals into a suitable digital format.

In some embodiments the ASIC 107 can comprise an activity determiner 151. The activity determiner in some embodiments can be configured to receive the digital format signals from the ADC 14 and generate a measure of the microphone activity, such as, for example the power of the signal. In some other embodiments the activity measurement can be a frequency dependent power spectrum for the microphone signal over a determined window or time period. In some embodiments the ASIC 107 can comprise a time-to-frequency domain converter such as a Fast Fourier Transform converter (FFT) or Discrete Fourier Transform converter (DFT) or any suitable time-to-frequency domain converter. In some embodiments the ASIC 107 can comprise a filterbank prior to the activity determiner 151 and configured to determine the activity of the microphone output for various frequency ranges.

In some embodiments the ASIC 107 can comprise a comparator configured to compare the output of the activity determiner 151 against at least one determined threshold value. The comparator can in some embodiments be a fixed or dynamic comparator configured to be able to vary the threshold values dependent on the condition of the MEMS microphone. For example in some embodiments the comparator 153 could vary the threshold values dependent on the age of the microphone, whether the microphone has been damaged or for any other suitable reason.

In some embodiments the ASIC 107 can comprise an actuator controller 155. The actuator controller can in some embodiments receive the output of the comparator 153 and generate a signal to power the tension actuator 161 within the MEMS microphone 103.

The ASIC 107 can in some embodiments comprise further elements of known microphone or audio processing systems such as a processing capability for biasing the MEMS microphone element (in other words generating the charge difference between the membrane and back plate), or a preamplifier (for receiving the analog audio signal and amplifying the analog audio signal so that the signal is output within a suitable potential range), or a equaliser or microphone filter. In some embodiments the equaliser can in a manner similar to that described herein attempt to filter the output of the microphone dependent on the level or operation of the tensioning of the membrane. Therefore, for example, the filter could implement an overpass filter to improve the outgoing signal quality when the membrane is tensioned because of wind noise and risk of saturation.

Figure 7:
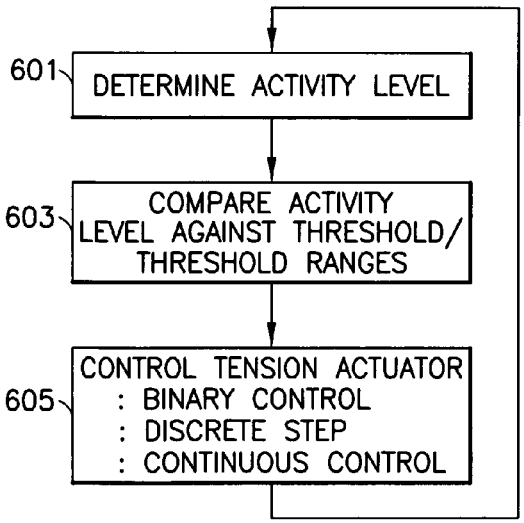
FIG. 7 shows a flow diagram showing the operation of the transducer in some embodiments.

With respect to FIG. 7, an example control mechanism and method is shown for controlling the tension actuator, membrane tensioning ring 207 in a wind noise reduction application.

As described herein, the MEMS microphone 103 generates, for example in some embodiments by the motion of the membrane relative to the back plate, a varying potential dependent on the acoustic waves or sound pressure level applying a force to the membrane 203. The ASIC 107 analogue-to-digital converter can in some embodiments generate a digital representation of the microphone output. Furthermore the activity determiner 151 can in some embodiments generate a representation of the microphone activity. This in some embodiments can comprise the activity determiner 151 being configured to determine the power level or the microphone output by squaring the output from the analogue-to-digital converter 14. However the activity level can in some embodiments be the frequency range dependent, in other words a value representing each frequency bin or range.

The determination of the activity value is shown in FIG. 7 by step 601.

In some embodiments the activity level can be passed to a comparator 153. The comparator 153 can in some embodiments compare this activity level or value against at least one determined threshold value. The at least one threshold value can be stored in the ASIC 107 or in a memory. In some embodiments the threshold value can be modified when the transducer is in use, in other words the comparator 153 can "learn" when the transducer is about to saturate or produce an activity level or value indicative of microphone saturation.

The comparator 153 can output the results of the comparison to the actuator controller 155.

The operation of comparing the activity level against the threshold or threshold values is shown in FIG. 7 by step 603.

The actuator controller 155 can then be configured to receive the results from the comparator 153 and output a suitable signal to control the tension actuator 161, in other words the tensioning ring or feature 207 to control the tensioning of the membrane.

The actuator controller 155 can in some embodiments be configured to operate a binary control mechanism, in other words when the comparator 153 determines that the activity level is less than or equal to the predetermined threshold value and sends a signal to the tension actuator 161 to actuate the tensioning ring or feature 207 such that the membrane is maintained in an untensioned mode and is more pliable. For example in some embodiments the actuator controller 155 can be configured to pass a voltage level to the membrane tensioning ring 207 such that the potential between the membrane 203 and the membrane tensioning ring 207 produces little or no force of attraction. However when the comparator 153 determines that the activity level is greater than a determined threshold value then the actuator controller 155 can send a signal to the tension actuator 161 to move the membrane closer to the tensioning ring, thus completely or fully tensioning the membrane and causing the membrane to become less pliable, in other words become less sensitive to changes in pressure and therefore produce less of a change in response to a similar sound pressure level differences.

In some embodiments the tension actuator control can be based on a discrete step profile control, in other words a series of threshold values are used to determine a series (or ranges) of activity levels and tension levels applied relative to the activity level region. Furthermore in some embodiments the actuator controller can be operated in a fully continuous control mode of operation whereby the tensioning voltage or bias and thus tensioning force applied is proportional to the activity level value.

The controlling of the actuator to move the membrane is shown in FIG. 7 by step 605.

Although the above control mechanism described herein shows the tensioning of the membrane dependent on the activity level of the microphone in order to prevent saturation of the microphone, it would be understood that the tensioning of the membrane could be carried out dependent on other sensed values or parameters. For example in some embodiments the control mechanism could be based to restrict the movement of the membrane where severe mechanical shock has been detected, for example to prevent mechanical damage to the microphone membrane when the device is dropped. Thus in some embodiments a sensor mechanism detecting the initial stages of severe mechanical shock, for example determining the object or apparatus is in freefall for greater than a determined threshold, can be used as an input to the actuator controller 155, thus tensioning the membrane in freefall.

It shall be appreciated that the term user equipment is intended to cover any suitable type of wireless user equipment, such as mobile telephones, portable data processing devices or portable web browsers. Furthermore, it will be understood that the term acoustic sound channels is intended to cover sound outlets, channels and cavities, and that such sound channels may be formed integrally with the transducer, or as part of the mechanical integration of the transducer with the device.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An acoustic transducer comprising:

a flexible membrane and a back plate; and a tension actuator for tensioning the flexible membrane, the tension actuator comprising a tensioning feature configured to be electrically controllable;

wherein the tensioning feature is configured to controllably apply a force to the flexible membrane to define a tension in the flexible membrane;

wherein at least one of the flexible membrane and the back late is char ed and the force is substantially defined by the tensioning feature and at least one of the flexible membrane and the back plate; and wherein the flexible membrane is pulled towards the tensioning feature when a tensioning voltage is applied.

2. The acoustic transducer as claimed in claim 1, wherein the tensioning feature comprises one of:

a tensioning feature coupled to the back plate;

a tensioning feature arranged close to the periphery of the flexible membrane;

a tensioning feature arranged close to the perimeter of the flexible membrane;

a tensioning feature coupled to a flexible membrane-facing surface of the back plate;

a tensioning feature coupled to a separate support structure arranged between the flexible membrane and the back plate; and a tensioning feature arranged on the other side of the flexible membrane than the back plate.

3. The acoustic transducer as claimed in claim 1, wherein the tensioning feature is electrically isolated from the back plate.

4. The acoustic transducer as claimed in claim 1, wherein the force comprises at least one of:

an attractive force;

a repulsive force;

a first force associated with a first direction; and a further force associated with a further direction.

5. The acoustic transducer as claimed in claim 1, wherein the tensioning feature comprises at least one of:

an electrostatically charged membrane tensioning ring; and an electrically charged membrane tensioning ring.

6. The acoustic transducer as claimed in claim 1, wherein the tensioning feature comprises a profiled tensioning ring, wherein the profile of the tensioning ring is configured to define a direction component of the force.

7. The acoustic transducer as claimed in claim 1, wherein the tension actuator is configured to affect the sensitivity of the flexible membrane.

8. The acoustic transducer as claimed in claim 1, wherein the tensioning feature comprises electrically controllable mechanical means for altering the tension of the flexible membrane.

9. An apparatus comprising:

the acoustic transducer as claimed in claim 1; and a controller configured to control the tension actuator of the acoustic transducer.

10. The apparatus as claimed in claim 9, further comprising a sensor configured to determine the activity of the acoustic transducer, wherein the controller is further configured to control the tension actuator dependent on the sensor value.

11. The apparatus as claimed in claim 10, further comprising a filter configured to receive the output of the acoustic transducer, wherein the controller is configured to control the filter dependent on the sensor value.

12. The apparatus as claimed in claim 9, further comprising a sensor configured to determine the acceleration of the acoustic transducer, wherein the controller is further configured to control the tension actuator dependent on the acceleration of the acoustic transducer.

13. The apparatus as claimed in claim 9, wherein the controller is configured to control the tension actuator in at least one of:

a binary mode of control;

a discrete stepwise control; and a continuous mode of control.

14. A method for an acoustic transducer comprising:

providing a flexible membrane and a back plate;

electrically controlling a tension actuator comprising a tensioning feature to controllably apply a force to the flexible membrane to define a tension in the flexible membrane;

charging at least one of the flexible membrane and the back plate, wherein the force is substantially defined by the tensioning feature and at least one of the flexible membrane and the back plate; and pulling the flexible membrane towards the tensioning feature when a tensioning voltage is applied.

15. The method as claimed in claim 14, further comprising coupling the tensioning feature to the back plate.

16. The method as claimed in claim 14, further comprising physically coupling a membrane charged member to the flexible membrane, wherein the membrane charged member is substantially independent from the tensioning feature and the flexible membrane.

17. The acoustic transducer as claimed in claim 1, wherein the tensioning feature comprises a membrane tensioning ring.

18. An apparatus, comprising:

an acoustic transducer including a membrane and a tension actuator configured to be electrically controllable to define the acoustic properties of the acoustic transducer dependent on the tension of the membrane;

a controller configured to control the tension actuator of the acoustic transducer; and a sensor configured to determine the acceleration of the acoustic transducer;

wherein the controller is further configured to control the tension actuator dependent on the acceleration of the acoustic transducer.

* * * * *

UNITED STATES PATENT AND TRADEMARK OFFICE

CERTIFICATE OF CORRECTION

PATENT NO. : 9,204,222 B2
APPLICATION NO. : 13/984395
DATED : December 1, 2015
INVENTOR(S) : Suvanto It is certified that error appears in the above-identified patent and that said Letters Patent is hereby corrected as shown below:

In the claims

Claim 1, col. 13, line 65 “char ed” should be deleted and --charged-- should be inserted.

Signed and Sealed this
Twenty-second Day of March, 2016

Michelle K. Lee

Michelle K. Lee
*Director of the United States Patent and Trademark Office*